US009558885B2

(12) United States Patent
Fujihara et al.

(10) Patent No.: US 9,558,885 B2
(45) Date of Patent: Jan. 31, 2017

(54) METHOD FOR PRODUCING SURFACE-MODIFIED RARE EARTH METAL-BASED SINTERED MAGNET

(75) Inventors: Mahoro Fujihara, Osaka (JP); Koshi Yoshimura, Osaka (JP)

(73) Assignee: HITACHI METALS, LTD., Tokyo (JP)

( * ) Notice: Subject to any disclaimer, the term of this patent is extended or adjusted under 35 U.S.C. 154(b) by 538 days.

(21) Appl. No.: 13/807,111

(22) PCT Filed: Jun. 29, 2011

(86) PCT No.: PCT/JP2011/064865

§ 371 (c)(1),
(2), (4) Date: Dec. 27, 2012

(87) PCT Pub. No.: WO2012/002412

PCT Pub. Date: Jan. 5, 2012

(65) Prior Publication Data

US 2013/0098509 A1 Apr. 25, 2013

(30) Foreign Application Priority Data

Jun. 30, 2010 (JP) ..... 2010-149602

(51) Int. Cl.
*C23C 8/10* (2006.01)
*H01F 41/00* (2006.01)
(Continued)

(52) U.S. Cl.
CPC ..... *H01F 41/005* (2013.01); *C22C 38/002* (2013.01); *C22C 38/005* (2013.01); *C22C 38/06* (2013.01);
(Continued)

(58) Field of Classification Search
CPC ..... C22C 38/002; C22C 38/005; C22C 38/06; C22C 38/10; C22C 38/16; C22C 2202/02; H01F 41/026; H01F 41/005; H01F 41/0577; B22F 2003/248; B22F 2201/03; B22F 2201/05; B22F 2999/00
See application file for complete search history.

(56) References Cited

U.S. PATENT DOCUMENTS

2010/0252145 A1* 10/2010 Fujihara et al. ..... 148/101

FOREIGN PATENT DOCUMENTS

CN 1537313 A 10/2004
JP 2001-160508 A1 6/2001
(Continued)

OTHER PUBLICATIONS

International Search Report for International Application No. PCT/JP2011/064865 dated Sep. 20, 2011.
(Continued)

*Primary Examiner* — Lois Zheng
(74) *Attorney, Agent, or Firm* — Kratz, Quintos & Hanson, LLP

(57) ABSTRACT

An object of the present invention is to provide a method for producing a surface-modified rare earth metal-based sintered magnet having extremely excellent corrosion resistance even in an environment with fluctuating temperature and humidity and also having excellent magnetic characteristics. The method for producing a surface-modified rare earth metal-based sintered magnet of the present invention as a means for achieving the object is characterized by comprising a step of subjecting a rare earth metal-based sintered magnet to a heat treatment at 200° C. to 600° C. in an atmosphere having an oxygen partial pressure of $1\times10^3$ Pa to $1\times10^5$ Pa and a water vapor partial pressure of 45 Pa or less with the ratio between the oxygen partial pressure and the water vapor partial pressure (oxygen partial pressure/water vapor partial pressure) being 450 to 20000.

3 Claims, 2 Drawing Sheets

(51) Int. Cl.

| | |
|---|---|
| ***H01F 41/02*** | (2006.01) |
| ***H01F 1/01*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |
| *B22F 3/24* | (2006.01) |
| *H01F 1/057* | (2006.01) |

(52) U.S. Cl.
CPC ..... *C22C 38/10* (2013.01); *C22C 38/16* (2013.01); *H01F 1/01* (2013.01); *H01F 41/026* (2013.01); *B22F 2003/248* (2013.01); *B22F 2999/00* (2013.01); *C22C 2202/02* (2013.01); *H01F 1/0577* (2013.01)

(56) References Cited

FOREIGN PATENT DOCUMENTS

| | | | |
|---|---|---|---|
| JP | 2006-19721 | A1 | 1/2006 |
| JP | 2007-103523 | A | 4/2007 |
| JP | 2007-207936 | A | 8/2007 |
| WO | WO 2009/041639 | A1 | 4/2009 |

OTHER PUBLICATIONS

First Office Action issued on Jan. 27, 2015 to the corresponding Chinese Patent Application No. 201180032708.X.

* cited by examiner

METHOD FOR PRODUCING SURFACE-MODIFIED RARE EARTH METAL-BASED SINTERED MAGNET

TECHNICAL FIELD

The present invention relates to a method for producing a surface-modified rare earth metal-based sintered magnet having sufficient corrosion resistance even in an environment with fluctuating temperature and humidity, such as a transportation environment or storage environment where temperature and humidity are not controlled, and also having excellent magnetic characteristics.

BACKGROUND ART

Rare earth metal-based sintered magnets such as R—Fe—B based sintered magnets represented by Nd—Fe—B based sintered magnets are produced from materials which are abundantly available and inexpensive as resources and also have high magnetic characteristics, and thus are used in various fields today. However, because a highly reactive rare earth metal: R is contained, they have the characteristic of being prone to oxidation corrosion in the air. Therefore, a rare earth metal-based sintered magnet is usually put to practical use with a corrosion resistant film formed thereon, such as a metal film or a resin film. However, in the case where the magnet is embedded in a component and used, such as use in an IPM (Interior Permanent Magnet) motor used as the drive motor of a hybrid car or an electric car, or incorporated into the compressor of an air conditioner, etc., the formation of such a corrosion resistant film on the surface of the magnet is not necessarily required. However, naturally, the corrosion resistance of the magnet needs to be ensured during the period from the production of the magnet until embedding in a component.

As mentioned above, a typical example of a method for imparting corrosion resistance to a rare earth metal-based sintered magnet is a method in which a corrosion resistant film such as a metal film or a resin film is formed on the surface of the magnet. However, in recent years, as a simple technique for improving corrosion resistance, attention has been focused on a method in which a rare earth metal-based sintered magnet is heat-treated in an oxidizing atmosphere (oxidative heat treatment) to modify the surface of the magnet. For example, Patent Document 1 and Patent Document 2 describe methods in which an oxidizing atmosphere is created using oxygen, and a heat treatment is performed therein, and Patent Document 3 to Patent Document 7 describe methods in which an oxidizing atmosphere is created using water vapor alone or a combination of water vapor and oxygen, and a heat treatment is performed therein. However, studies by the present inventors have revealed that even when a rare earth metal-based sintered magnet is surface-modified by such a method, sufficient corrosion resistance is not necessarily obtained in an environment where fine dew drops are repeatedly formed on the surface of the magnet due to the fluctuation of temperature and humidity, such as a transportation environment or storage environment where temperature and humidity are not controlled. The studies have also revealed that although the preferred water vapor partial pressure according to Patent Document 3 to Patent Document 7 is 10 hPa (1000 Pa) or more, when a heat treatment is performed in an atmosphere having such a high water vapor partial pressure, a large amount of hydrogen is produced as a by-product of the oxidation reaction that occurs on the surface of the magnet, and the magnet absorbs the produced hydrogen and thus embrittles, causing the deterioration of magnetic characteristics. Therefore, as an improved method for surface-modifying a rare earth metal-based sintered magnet, the present inventors have proposed, in Patent Document 8, a method in which a heat treatment is performed in an oxidizing atmosphere where the oxygen partial pressure and also the water vapor partial pressure of less than 10 hPa, which is regarded as unsuitable in Patent Document 3 to Patent Document 7, are appropriately controlled. Specifically, they have proposed a method in which a heat treatment is performed at 200° C. to 600° C. in an atmosphere having an oxygen partial pressure of $1\times10^2$ Pa to $1\times10^5$ Pa and a water vapor partial pressure of 0.1 Pa to 1000 Pa (excluding 1000 Pa).

PRIOR ART DOCUMENTS

Patent Documents

Patent Document 1: Japanese Patent No. 2844269
Patent Document 2: JP-A-2002-57052
Patent Document 3: JP-A-2006-156853
Patent Document 4: JP-A-2006-210864
Patent Document 5: JP-A-2007-103523
Patent Document 6: JP-A-2007-207936
Patent Document 7: JP-A-2008-244126
Patent Document 8: WO 2009/041639

SUMMARY OF THE INVENTION

Problems that the Invention is to Solve

According to the method for surface-modifying a rare earth metal-based sintered magnet proposed by the present inventors in Patent Document 8, sufficient corrosion resistance even in an environment with fluctuating temperature and humidity is imparted by the oxidative heat treatment, and also the deterioration of magnetic characteristics due to the oxidative heat treatment can be suppressed. As a result, the problems of the surface modification methods described in Patent Document 1 to Patent Document 7 are beautifully solved. However, further studies have revealed that even when a rare earth metal-based sintered magnet is surface-modified by the surface modification method described in Patent Document 8, in the case where the magnet is subjected to an accelerated test for corrosion resistance under severe high-temperature and high-humidity conditions, rusted magnets exist only very slightly.

Thus, an object of the present invention is to provide a method for producing a surface-modified rare earth metal-based sintered magnet having extremely excellent corrosion resistance even in an environment with fluctuating temperature and humidity and also having excellent magnetic characteristics.

Means for Solving the Problems

In light of the above points, the present inventors have conducted extensive research to see if the method for surface-modifying a rare earth metal-based sintered magnet proposed in Patent Document 8 could be improved. As a result, they have found that when the water vapor partial pressure is minimized, and the ratio between the oxygen partial pressure and the water vapor partial pressure (oxygen partial pressure/water vapor partial pressure) is higher than the preferred ratio of Patent Document 8 (1 to 400), the corrosion resistance can be improved.

A method for producing a surface-modified rare earth metal-based sintered magnet according to the present invention accomplished based on the above findings is, as defined in claim 1, characterized by comprising a step of subjecting a rare earth metal-based sintered magnet to a heat treatment at 200° C. to 600° C. in an atmosphere having an oxygen partial pressure of $1\times10^3$ Pa to $1\times10^5$ Pa and a water vapor partial pressure of 45 Pa or less with the ratio between the oxygen partial pressure and the water vapor partial pressure (oxygen partial pressure/water vapor partial pressure) being 450 to 20000.

The production method as defined in claim 2 is characterized in that in the production method of claim 1, the atmosphere has a total pressure of $9\times10^4$ Pa to $1.2\times10^5$ Pa.

The production method as defined in claim 3 is characterized in that in the production method of claim 1, heating from ordinary temperature to the temperature of the heat treatment and/or cooling after the heat treatment is performed in the same atmosphere as the atmosphere in which the heat treatment is performed.

Further, a surface-modified rare earth metal-based sintered magnet according to the present invention is, as defined in claim 4, characterized by being produced by the production method of claim 1.

The rare earth metal-based sintered magnet as defined in claim 5 is characterized in that in the rare earth metal-based sintered magnet of claim 4, it has a surface potential difference of 0.35 V or less.

The rare earth metal-based sintered magnet as defined in claim 6 is characterized in that in the rare earth metal-based sintered magnet of claim 4, it contains, as components of a modification layer, an iron oxide made substantially of hematite and an R oxide made substantially of $R_2O_3$.

Effect of the Invention

The invention enables the provision of a method for producing a surface-modified rare earth metal-based sintered magnet having extremely excellent corrosion resistance even in an environment with fluctuating temperature and humidity and also having excellent magnetic characteristics.

BRIEF DESCRIPTION OF THE DRAWINGS

Similarly.

Similarly.

MODE FOR CARRYING OUT THE INVENTION

Figure 1:
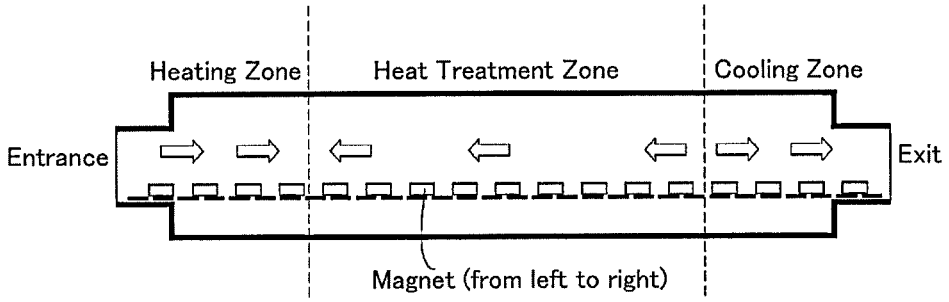
FIG. 1 is a schematic diagram (side view) of an example of a continuous treatment furnace that can be suitably applied for the method for producing a surface-modified rare earth metal-based sintered magnet of the present invention.

The method for producing a surface-modified rare earth metal-based sintered magnet of the present invention is characterized by comprising a step of subjecting a rare earth metal-based sintered magnet to a heat treatment at 200° C. to 600° C. in an atmosphere having an oxygen partial pressure of $1\times10^3$ Pa to $1\times10^5$ Pa and a water vapor partial pressure of 45 Pa or less with the ratio between the oxygen partial pressure and the water vapor partial pressure (oxygen partial pressure/water vapor partial pressure) being 450 to 20000.

The reason that the oxygen partial pressure is specified as $1\times10^3$ Pa to $1\times10^5$ Pa is as follows. When the oxygen partial pressure is less than $1\times10^3$ Pa, it may happen that the amount of oxygen in the atmosphere is so small that it takes too much time to modify the surface of the magnet. It may also happen that a portion of the magnet that is in contact with the magnet-holding member is not sufficiently surface-modified, and, as a result, such a portion does not have sufficient corrosion resistance imparted or has traces of contact with the holding member. Meanwhile, even when the oxygen partial pressure is more than $1\times10^5$ Pa, such an increase in the oxygen partial pressure may not improve corrosion resistance much, and may only increase the cost. Therefore, in order to achieve the desired modification of the surface of a magnet more effectively at lower cost, it is preferable that the oxygen partial pressure is $1\times10^4$ Pa to $3\times10^4$ Pa. The reason that the water vapor partial pressure is specified as 45 Pa or less is as follows. When the water vapor partial pressure is more than 45 Pa, it may happen that the amount of water vapor in the atmosphere is so large that a stable modification layer having excellent corrosion resistance cannot be formed on the surface of the magnet. Incidentally, no particular lower limit is imposed on the water vapor partial pressure, but a lower limit of 1 Pa is usually preferable. The reason that the ratio between the oxygen partial pressure and the water vapor partial pressure (oxygen partial pressure/water vapor partial pressure) is specified as 450 to 20000 is as follows. When the ratio is less than 450, it may happen that the amount of water vapor in the atmosphere relative to the amount of oxygen is so large that a stable modification layer having excellent corrosion resistance cannot be formed on the surface of the magnet. Meanwhile, an atmosphere where the ratio is more than 20000 can be called a special environment and is not practical. Therefore, the ratio is preferably 500 to 10000, and more preferably 600 to 5000. The atmosphere in a treatment chamber may be created by separately introducing these oxidizing gases to the predetermined partial pressures, or may also be created by introducing air having such a dew point that these oxidizing gases are contained at the predetermined partial pressures, for example. In addition, an inert gas such as nitrogen or argon may also be present in the treatment chamber. When the total pressure of the atmosphere is atmospheric pressure or a pressure close thereto (specifically, e.g., $9\times10^4$ Pa to $1.2\times10^5$ Pa), the predetermined atmosphere can be easily created without requiring any special pressure control means, and the surface modification of a magnet can be performed. It can be said that this is an advantage of the present invention.

The reason that the heat treatment temperature is specified as 200° C. to 600° C. is as follows. When the heat treatment temperature is less than 200° C., it may be difficult to perform the desired modification of the surface of the magnet. Meanwhile, when the heat treatment temperature is more than 600° C., magnetic characteristics of the magnet may be adversely affected. Therefore, the heat treatment temperature is preferably 240° C. to 500° C., and more preferably 350° C. to 450° C. The heat treatment time is preferably 1 minute to 3 hours, and more preferably 15 minutes to 2.5 hours. When the time is too short, it may be difficult to perform the desired modification of the surface of the magnet, while when the time is too long, magnetic characteristics of the magnet may be adversely affected.

Incidentally, it is preferable that the step of heating the magnet from ordinary temperature to the temperature of the heat treatment is performed in the same atmosphere as the atmosphere in which the heat treatment is performed. When the same atmosphere as the atmosphere in which the heat treatment is performed is employed, not a small amount of moisture naturally adsorbed on the magnet surface is desorbed at an early stage. As a result, the adverse effect of moisture present on the magnet surface on the magnet during heating can be minimized. There also is an advantage in that after heating, the heat treatment can be continuously performed without changing the atmosphere in the treatment chamber. The heating rate may be 100° C./h to 2000° C./h, for example. Incidentally, "ordinary temperature" herein refers to the temperature of the environment in which the rare earth metal-based sintered magnet to be surface-modified is placed at the time when heating is started (e.g., room temperature). For example, it means the temperature specified as 5° C. to 35° C. in JIS Z 8703 (Japanese Industrial Standards).

In addition, it is preferable that the step of cooling the heat-treated magnet is also performed in the same atmosphere as the atmosphere in which the heat treatment is performed. When cooling is performed in such an atmosphere, the phenomenon of condensation on the surface of the magnet during the step, which causes the rusting of the magnet and deteriorates magnetic characteristics, can be prevented.

The step of heating a magnet from ordinary temperature to the temperature of the heat treatment, the step of heat-treating the magnet, and the step of cooling the heat-treated magnet may be performed by successively changing the environment in the magnet-containing treatment chamber into environments for performing the respective steps. Alternatively, the steps may also be performed by dividing the treatment chamber into zones controlled to have environments for performing the respective steps, and successively moving the magnet from zone to zone.

FIG. 1 is a schematic diagram (side view) of an example of a continuous treatment furnace that is internally divided into zones controlled to have environments for performing the above three steps, allowing the respective steps to be performed by successively moving a magnet from zone to zone. In the continuous treatment furnace shown in FIG. 1, a magnet is subjected to each treatment while being moved by a moving means, such as a conveyor belt, from left to right in the figure. The arrow shows an atmosphere gas flow in each zone formed by an air supply means and an air exhaust means (not shown). The entrance of the heating zone and the exit of the cooling zone are each screened by an air curtain, for example, and the boundary between the heating zone and the heat treatment zone and the boundary between the heat treatment zone and the cooling zone are each defined by the atmosphere gas flow shown by the arrow, for example (such zoning may also be mechanically performed by a shutter). The use of such a continuous treatment furnace allows a large number of magnets to be continuously surface-modified with stable quality.

It is likely that when a rare earth metal-based sintered magnet is surface-modified through the above steps, a uniform modification layer is formed on the surface of the magnet with a surface potential difference (difference between the highest potential and the lowest potential) of 0.35 V or less, whereby corrosion due to a potential difference is effectively suppressed, and, as a result, corrosion resistance is improved. The modification layer located on the main phase of the surface of the magnet is constituted by an iron oxide made mainly of hematite ($\alpha$-$Fe_2O_3$) having excellent stability, while the modification layer located on the grain boundary triple point is constituted by an R oxide made mainly of $R_2O_3$ having excellent stability. It is preferable that the iron oxide contained as a component of the modification layer contains 75 mass % or more hematite. The proportion is more preferably 80 mass % or more, and still more preferably 90 mass % or more. In addition, it is preferable that the R oxide contained as a component of the modification layer contains 75 mass % or more $R_2O_3$. The proportion is more preferably 80 mass % or more, and still more preferably 90 mass % or more. Incidentally, the proportion of hematite in the iron oxide and the proportion of $R_2O_3$ in the R oxide can be analyzed by Raman spectrometry, for example.

Incidentally, it is preferable that the surface modification layer formed on the surface of the rare earth metal-based sintered magnet has a thickness of 0.5 μm to 10 μm. When the thickness is too small, sufficient corrosion resistance may not be exhibited, while when the thickness is too large, magnetic characteristics of the magnet may be adversely affected.

As a rare earth metal-based sintered magnet to which the present invention is applied, an R—Fe—B based sintered magnet produced by the following production method can be mentioned, for example.

An alloy containing a rare earth element R: 25 mass % to 40 mass %, B (boron): 0.6 mass % to 1.6 mass %, the remainder Fe, and inevitable impurities is prepared. Here, R may contain a heavy rare earth element RH. In addition, B may be partially substituted with C (carbon), and Fe may be partially (50 mass or less) substituted with another transition metal element (e.g., Co or Ni). According to various purposes, the alloy may also contain at least one additional element M selected from the group consisting of Al, Si, Ti, V, Cr, Mn, Ni, Cu, Zn, Ga, Zr, Nb, Mo, Ag, In, Sn, Hf, Ta, W, Pb, and Bi in an amount of about 0.01 mass % to about 1.0 mass %.

The above alloy can be suitably produced by rapidly cooling a molten raw material alloy by a strip casting method, for example. Hereinafter, the production of a rapidly solidified alloy by a strip casting method will be described.

First, a raw material alloy having the above composition is melted by high-frequency melting in an argon atmosphere to prepare a molten raw material alloy. Next, the molten alloy is maintained at about 1350° C. and then rapidly cooled by a single-roll method to give a flaky alloy ingot having a thickness of about 0.3 mm, for example. Prior to the subsequent hydrogen pulverizing treatment, the alloy slab thus produced is crushed into flakes with a size of 1 mm to 10 mm, for example. Incidentally, a method for producing a raw material alloy by a strip casting method is disclosed in U.S. Pat. No. 5,383,978, for example.

[Coarse Pulverizing Step]

The above alloy slab coarsely crushed into flakes is housed inside a hydrogen furnace. Next, a hydrogen embrittlement treatment (hereinafter sometimes referred to as "hydrogen pulverizing treatment" or simply as "hydrogen treatment") step is performed inside the hydrogen furnace. When the coarsely pulverized powder alloy powder is removed from the hydrogen furnace after the hydrogen pulverizing treatment, it is preferable that the removal operation is conducted in an inert atmosphere so that the coarsely pulverized powder does not come into contact with the air. This is because the coarsely pulverized powder is thus prevented from oxidation or heat generation, whereby the deterioration of magnetic characteristics of the magnet can be suppressed.

By the hydrogen pulverizing treatment, the rare earth alloy is pulverized into a size of about 0.1 mm to about several millimeters with an average particle size of 500 μm or less. It is preferable that after the hydrogen pulverizing treatment, the embrittled raw material alloy is further disintegrated and size-reduced, followed by cooling. In the case where the raw material is removed while maintaining a relatively high temperature state, the time of the cooling treatment may be relatively long.

[Finely Grinding Step]

Next, the coarsely pulverized powder is finely ground using a jet mill grinding apparatus. The jet mill grinding apparatus used in this embodiment has a cyclone classifier connected thereto. The jet mill grinding apparatus receives the rare earth alloy that has been coarsely pulverized in the coarse pulverizing step (coarsely pulverized powder) and grinds the same in a grinder. The powder ground in the grinder is collected in a recovery tank through the cyclone classifier. Thus, a fine powder with a size of about 0.1 μm to about 20 μm (typically the average particle size is 3 μm to 5 μm) can be obtained. The grinding apparatus used for such fine grinding is not limited to a jet mill and may also be an attritor or a ball mill. For grinding, it is also possible to use a lubricant such as zinc stearate as a grinding aid.

[Press Molding]

In this embodiment, to the magnetic powder produced by the above method, a lubricant is added and mixed in an amount of 0.3 mass %, for example, using a rocking mixer, for example, whereby the surface of alloy powder particles is coated with the lubricant. Next, the magnetic powder produced by the above method is molded in an oriented magnetic field using a known pressing apparatus. The intensity of the magnetic field applied is 1.5 Tesla to 1.7 Tesla (T), for example. In addition, the molding pressure is set so that the resulting molding body has a green density of about 4.0 $g/cm^3$ to about 4.5 $g/cm^3$, for example.

[Sintering Step]

The above powder molding body is subjected to this step at a temperature within a range of 1000° C. to 1200° C. for 10 minutes to 240 minutes, for example. It is also possible to successively perform a step of retention at a temperature within a range of 650° C. to 1000° C. for 10 minutes to 240 minutes and a subsequent step of further sintering at a temperature higher than the above retention temperature (e.g., 1000° C. to 1200° C.). During sintering, especially when a liquid phase is generated (when the temperature is within a range of 650° C. to 1000° C.), the R-rich phase in the grain boundary phase starts melting to form a liquid phase. Subsequently, sintering proceeds, and a sintered magnet body is thus formed. After the sintering step, an aging treatment (400° C. to 700° C.) or grinding for size adjustment may also be performed.

The surface-modified rare earth metal-based sintered magnet produced by the production method of the present invention has excellent corrosion resistance imparted by the oxidative heat treatment, and also the deterioration of its magnetic characteristics due to the oxidative heat treatment is suppressed. Therefore, the magnet is suitable for use in an IPM motor used as the drive motor of a hybrid car or an electric car, or incorporated in the compressor of an air conditioner, etc., for example. Incidentally, in the case where an IPM motor is produced using a surface-modified rare earth metal-based sintered magnet produced by the production method of the present invention, the production may be performed through a step of embedding the magnet inside a rotor.

EXAMPLES

Hereinafter, the present invention will be described in further detail with reference to examples, but it should be understood that the present invention is not limited thereto.

Example 1

An alloy flake having the composition Nd: 18.5, Pr: 5.7, Dy: 7.2, B: 1.00, Co: 0.9, Cu: 0.1, Al: 0.2, and the remainder: Fe (unit: mass o) with a thickness of 0.2 mm to 0.3 mm was produced by a strip casting method.

Next, the alloy flake was placed in a container and housed in a hydrogen treatment apparatus. The inside of the hydrogen treatment apparatus was then filled with hydrogen gas at a pressure of 500 kPa, whereby hydrogen was occluded by the alloy flake at room temperature and then released. By such hydrogen treatment, the alloy flake was embrittled, producing a coarsely pulverized powder with a size of about 0.15 mm to about 0.2 mm.

To the coarsely pulverized powder produced by the above hydrogen treatment, zinc stearate was added and mixed as a grinding aid in an amount of 0.04 massa. The mixture was then subjected to a grinding step using a jet mill apparatus to produce a fine powder with a powder particle size of about 3 μm.

The fine powder thus produced was molded using a pressing apparatus to produce a powder molding body. Specifically, a press molding was performed by magnetically orienting the powder particles in an applied magnetic field and pressing. Subsequently, the molding body was removed from the pressing apparatus and subjected to a sintering step in a vacuum furnace at 1050° C. for 4 hours to give a sintered body block.

The obtained sintered body block was subjected to an aging treatment in vacuum at 490° C. for 2.5 hours. After that, the surface was ground to adjust the size to 6 mm in thickness×7 mm in length×7 mm in width and then ultrasonically washed with water to give a sintered magnet.

By the following method using the continuous treatment furnace shown in FIG. 1, the sintered magnet obtained by the above method was subjected to a heating step, an oxidative heat treatment step, and a cooling step, thereby modifying the surface.

(1) Heating Step

Heating from ordinary temperature (=25° C.; the same applies hereinafter) to the temperature of the oxidative heat treatment (400° C.) was performed in an atmosphere of air with a dew point of −35° C. (oxygen partial pressure: 20000 Pa, water vapor partial pressure: 32 Pa, oxygen partial pressure/water vapor partial pressure=625; the same applies hereinafter) at a heating rate of 500° C./h.

(2) Oxidative Heat Treatment Step

A heat treatment was performed at 400° C. for 30 minutes in an atmosphere of air with a dew point of −35° C.

(3) Cooling Step

The temperature was allowed to fall naturally from 400° C. to ordinary temperature in an atmosphere of air with a dew point of −35° C.

The modification layer formed on the surface of the sintered magnet by the above method had a thickness of 2.2 μm. Incidentally, the thickness of the modification layer was measured as follows. The surface-modified sintered magnet was embedded in resin and polished. Subsequently, a sample was produced using an ion beam cross section polisher (SM09010: manufactured by JEOL LTD.), and the cross section was observed using a field-emission type scanning electron microscope (S-4300: manufactured by Hitachi High-Technologies Corporation) (the same applies hereinafter).

Example 2

Surface modification was performed by the same method as in Example 1, except that the heating step, the oxidative heat treatment step, and the cooling step were performed in an atmosphere of air with a dew point of −45° C. (oxygen partial pressure: 20000 Pa, water vapor partial pressure: 11 Pa, oxygen partial pressure/water vapor partial pressure=1818). As a result, the thickness of the modification layer formed on the surface of the sintered magnet was 1.9 μm.

Example 3

Surface modification was performed by the same method as in Example 1, except that the oxidative heat treatment step was performed at 340° C. for 2 hours. As a result, the thickness of the modification layer formed on the surface of the sintered magnet was 1.3 μm.

Example 4

Surface modification was performed by the same method as in Example 1, except that the heating step, the oxidative heat treatment step, and the cooling step were performed in an atmosphere of air with a dew point of −32° C. (oxygen partial pressure: 20000 Pa, water vapor partial pressure: 42 Pa, oxygen partial pressure/water vapor partial pressure=476). As a result, the thickness of the modification layer formed on the surface of the sintered magnet was 1.8 μm.

Example 5

Surface modification was performed by the same method as in Example 1, except that the heating step, the oxidative heat treatment step, and the cooling step were performed in an atmosphere of air with a dew point of −60° C. (oxygen partial pressure: 20000 Pa, water vapor partial pressure: 2 Pa, oxygen partial pressure/water vapor partial pressure=10000). As a result, the thickness of the modification layer formed on the surface of the sintered magnet was 2.2 μm.

Comparative Example 1

Surface modification was performed by the same method as in Example 1, except that the heating step, the oxidative heat treatment step, and the cooling step were performed in an atmosphere of air with a dew point of 0° C. (oxygen partial pressure: 20000 Pa, water vapor partial pressure: 600 Pa, oxygen partial pressure/water vapor partial pressure=33.3). As a result, the thickness of the modification layer formed on the surface of the sintered magnet was 2.0 μm.

Comparative Example 2

Surface modification was performed by the same method as in Example 1, except that the heating step, the oxidative heat treatment step, and the cooling step were performed in an atmosphere of air with a dew point of 10° C. (oxygen partial pressure: 20000 Pa, water vapor partial pressure: 1230 Pa, oxygen partial pressure/water vapor partial pressure=16.3). As a result, the thickness of the modification layer formed on the surface of the sintered magnet was 2.3 μm.

Comparative Example 3

Surface modification was performed by the same method as in Example 1, except that the heating step, the oxidative heat treatment step, and the cooling step were performed in an atmosphere of air at a temperature of 21° C.×a relative humidity of 63% (oxygen partial pressure: 20000 Pa, water vapor partial pressure: 1570 Pa, oxygen partial pressure/water vapor partial pressure=12.7). As a result, the thickness of the modification layer formed on the surface of the sintered magnet was 2.2 μm.

Comparative Example 4

Surface modification was performed by the same method as in Example 1, except that the heating step, the oxidative heat treatment step, and the cooling step were performed using a vacuum heat treatment furnace in a reduced-pressure oxygen atmosphere with a dew point of −60° C. (water vapor partial pressure: 2 Pa) at a pressure of 100 Pa (0.75 Torr) (oxygen partial pressure/water vapor partial pressure=50). As a result, the thickness of the modification layer formed on the surface of the sintered magnet was 1.6 μm.

Test Example 1

1000 sintered magnets were prepared, and, under the conditions of Example 1, 100 of the sintered magnets were surface-modified per treatment. The treatment was performed 10 times in total to give 1000 surface-modified sintered magnets. In the same manner, under the conditions of each of Example 2 to Example 5 and Comparative Example 1 to Comparative Example 4, the treatment was performed 10 times in total to give 1000 surface-modified sintered magnets for each example. The surface-modified sintered magnets thus obtained were subjected to an accelerated test for corrosion resistance under high-temperature and high-humidity conditions at a temperature of 60° C.×a relative humidity of 90% for 24 hours. After that, the appearance was observed to check the number of rusted magnets out of the 1000 magnets. The results are shown in Table 1. Incidentally, Table 1 also shows the results of the above accelerated test for corrosion resistance on 1000 sintered magnets before surface modification (Reference Example).

TABLE 1

| | Example 1 | Example 2 | Example 3 | Example 4 | Example 5 | Comparative Example 1 | Comparative Example 2 | Comparative Example 3 | Comparative Example 4 | Reference Example |
|---|---|---|---|---|---|---|---|---|---|---|
| Number of Rusted Magnets | 0 | 0 | 0 | 0 | 0 | 3 | 127 | 203 | 259 | 976 |

As is clear from Table 1, no magnets rusted in Example 1 to Example 5. However, in Comparative Example 1 corresponding to the surface modification method described in Patent Document 8, 0.3% of the magnets rusted. Although the results of Comparative Example 1 were much better than the results of Comparative Example 2 to Comparative Example 4 corresponding to the surface modification methods described in Patent Document 1 to Patent Document 7, the results of Example 1 to Example 5 were even better than the results of Comparative Example 1. Incidentally, on the surfaces of the surface-modified sintered magnets obtained in Comparative Example 4, traces of contact with a member of the vacuum heat treatment furnace on which the sintered magnets had been placed were seen, and the rusting of such portions was significant. Such traces of contact were not seen on the surfaces of the surface-modified sintered magnets obtained in Examples and other Comparative Examples. Therefore, it is likely that the reason for this phenomenon is that the amount of oxygen in the atmosphere employed in Comparative Example 4 was too small.

Test Example 2

With reference to the neutral salt spray cycle test method in accordance with JIS H8502-1999, a cycle test excluding salt spraying and including only drying and wetting was performed on 10 of the surface-modified sintered magnets obtained in each of Example 1 to Example 5 and Comparative Example 1 (samples obtained in separate lots) (the number of cycles: 3 and 6). After the test, a rating number evaluation (corrosion defect evaluation in accordance with JIS H8502-1999) was performed. A magnet having a rating number of 7 or more was rated as acceptable, while a magnet having a rating number of less than 7 was rated as unacceptable, and the number of magnets rated as unacceptable out of the 10 magnets was checked. As a result, in all of Example 1 to Example 5 and Comparative Examples 1, the number of magnets rated as unacceptable was 0.

(Summary and Discussion)

The above results of the accelerated test for corrosion resistance in Test Example 1 and the drying-wetting cycle test in Test Example 2 show the following. The surface modification method described in Patent Document 8 is an excellent method for imparting corrosion resistance to a rare earth metal-based sintered magnet, and also no particular deterioration of magnetic characteristics was observed after the tests. Therefore, it was confirmed that the method fully satisfies requirements for practical use. However, the surface modification method of the present invention is an even better method for imparting corrosion resistance, and also no particular deterioration of magnetic characteristics was observed after the tests.

Figure 2:
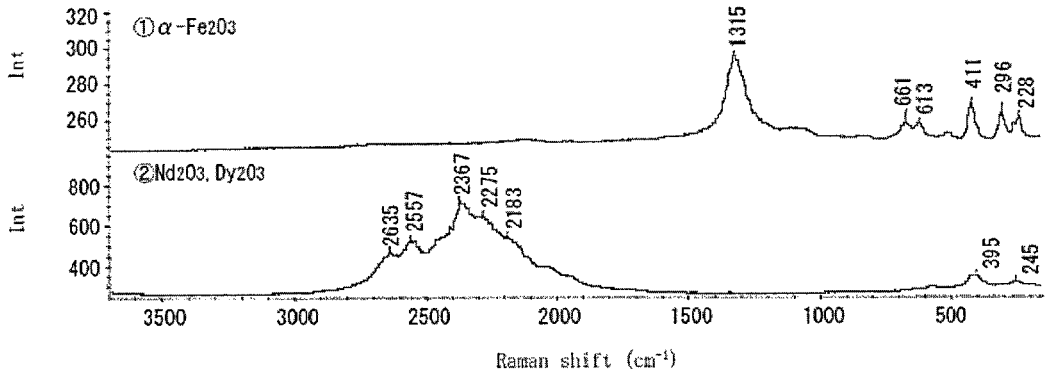
FIG. 2 shows the results of the analysis of the components of a modification layer formed on the surface of a sintered magnet by a treatment under the conditions of Example 1 in the Examples, which was performed using a Raman spectrometer.
Figure 3:
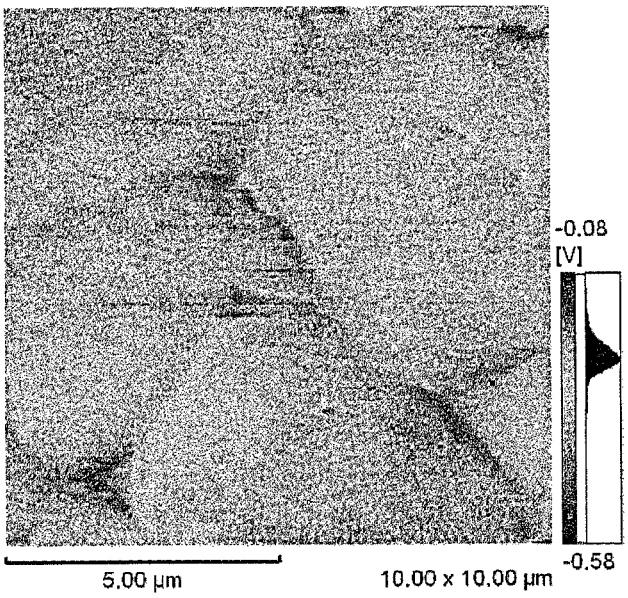
FIG. 3 shows a potential mapping image of the surface of a sintered magnet surface-modified by a treatment under the conditions of Example 1.
Figure 4:
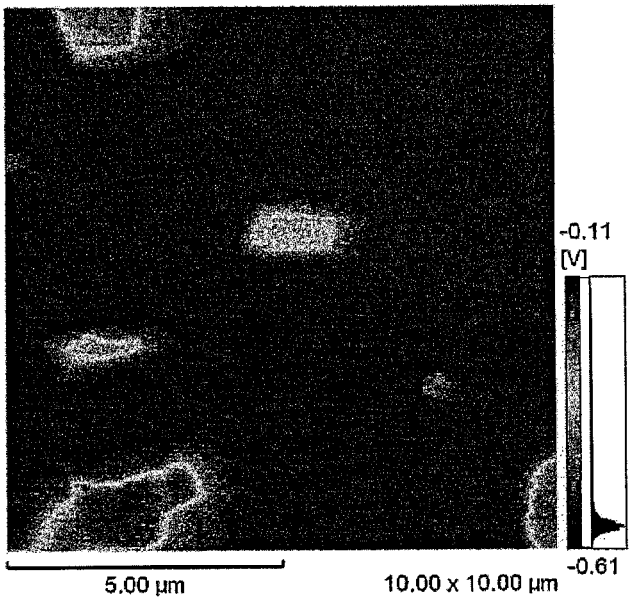
FIG. 4 shows a potential mapping image of the surface of a sintered magnet before surface modification.

As a result of the analysis of the surface of the surface-modified sintered magnet obtained in Example 1 using a Raman spectrometer (Holo Lab 5000 R, manufactured by KAISER OPTICAL SYSTEM INC.), the components of the surface modification layer substantially detected were only hematite and $R_2O_3$, which have excellent stability (FIG. 2). It was thus shown that the modification layer formed on the surface of the sintered magnet in Example 1 contains as components an iron oxide made substantially of hematite and an R oxide made substantially of $R_2O_3$. In addition, separately, a sintered magnet was mirror-finished by a wet process and then treated under the conditions of Example 1, and the resulting surface-modified sintered magnet was measured for surface potential distribution using a scanning probe microscope (SPM-9600, manufactured by SHIMADZU CORPORATION). FIG. 3 shows the potential mapping image thus obtained. As is obvious from FIG. 3, the sintered magnet surface-modified by a treatment under the conditions of Example 1 had an extremely uniform surface potential distribution within a range of −0.10 V to −0.34 V with a surface potential difference of 0.24 V. Meanwhile, the sintered magnet before surface modification had a non-uniform surface potential distribution within a range of −0.13 V to −0.60 V with a surface potential difference of 0.47 V (the potential mapping image is shown in FIG. 4). It is thus likely that the reason that the surface-modified sintered magnet obtained in Example 1 has extremely excellent corrosion resistance is that corrosion due to a potential difference is effectively suppressed.

The present inventors have separately confirmed the following by cross-sectional composition analysis using a scanning electron microscope and an energy dispersive X-ray analyzer and also by surface analysis using a Raman spectrometer. In the case where a mirror-finished sintered magnet is surface-modified under the conditions of Example 1, the modification layer located on the main phase is constituted by an iron oxide made mainly of hematite having excellent stability, while the modification layer located on the grain boundary triple point is constituted by an R oxide made mainly of $R_2O_3$ having excellent stability. Meanwhile, in the case where surface modification is performed under the conditions of Comparative Example 1, as a difference from the case of surface modification under the conditions of Example 1, a compound that presumably is an unstable R compound, such as an R hydroxide, is present in addition to $R_2O_3$ in the modification layer located on the grain boundary triple point. Therefore, it is likely that the difference in the results of the accelerated test for corrosion resistance between the surface-modified sintered magnet of Example 1 and that of Comparative Example 1 is due to the difference in the components of the modification layer located on the grain boundary triple point that is present in a small amount on the surface of the magnet.

Application Example 1

Through a step of embedding the surface-modified sintered magnet obtained in Example 1 inside a rotor, an IPM motor for use as the drive motor of a hybrid car or an electric car was produced.

Example 6

Surface modification was performed by the same method as in Example 1, except that a sintered magnet was obtained using an alloy flake having the composition Nd: 16.2, Pr: 4.5, Dy: 9.1, B: 0.93, Co: 2.0, Cu: 0.1, Al: 0.15, Ga: 0.07, and the remainder: Fe (unit: mass %) with a thickness of 0.2 mm to 0.3 mm, and that the heating step, the oxidative heat treatment step, and the cooling step were performed in an atmosphere of air with a dew point of −51° C. (oxygen partial pressure: 20000 Pa, water vapor partial pressure: 6 Pa, oxygen partial pressure/water vapor partial pressure=3333). As a result, the thickness of the modification layer formed on the surface of the sintered magnet was 2.0 μm.

Example 7

Surface modification was performed by the same method as in Example 6, except that the heating step, the oxidative heat treatment step, and the cooling step were performed in an atmosphere of air with a dew point of −54° C. (oxygen partial pressure: 20000 Pa, water vapor partial pressure: 4 Pa, oxygen partial pressure/water vapor partial pressure=5000), and that the oxidative heat treatment step was performed at 400° C. for 20 minutes. As a result, the thickness of the modification layer formed on the surface of the sintered magnet was 1.6 μm.

Example 8

Surface modification was performed by the same method as in Example 5, except that a sintered magnet was obtained using an alloy flake having the composition Nd: 19.8, Pr: 5.7, Dy: 4.3, B: 0.93, Co: 2.0, Cu: 0.1, Al: 0.15, Ga: 0.07, and the remainder: Fe (unit: mass %) with a thickness of 0.2 mm to 0.3 mm, the heating step was performed at a heating rate of 520° C./h, and the oxidative heat treatment step was performed at 420° C. for 20 minutes. As a result, the thickness of the modification layer formed on the surface of the sintered magnet was 1.8 μm.

Comparative Example 5

Surface modification was performed by the same method as in Comparative Example 1, except that the heating step and the cooling step were performed in an atmosphere of air with a dew point of −60° C. (oxygen partial pressure: 20000 Pa, water vapor partial pressure: 2 Pa, oxygen partial pressure/water vapor partial pressure=10000). As a result, the thickness of the modification layer formed on the surface of the sintered magnet was 1.9 μm.

Test Example 3

An accelerated test for corrosion resistance was performed on 1000 of the sintered magnets of each of Example 6 to Example 8 and Comparative Example 5 by the same method as in Test Example 1, and the number of rusted magnets was checked. The results are shown in Table 2. As is clear from Table 2, no magnets rusted in Example 6 to Example 8.

TABLE 2

| | Example 6 | Example 7 | Example 8 | Comparative Example 5 |
|---|---|---|---|---|
| Number of Rusted Magnets | 0 | 0 | 0 | 5 |

INDUSTRIAL APPLICABILITY

The present invention makes it possible to provide a method for producing a surface-modified rare earth metal-based sintered magnet having extremely excellent corrosion resistance even in an environment with fluctuating temperature and humidity and also having excellent magnetic characteristics. In this respect, the present invention is industrially applicable.

The invention claimed is:

1. A method for producing a surface-modified rare earth metal-based sintered magnet, consisting of:

a step of heating a rare earth metal-based sintered magnet from ordinary temperature to a heat treatment temperature of 200° C. to 600° C. in an atmosphere having an oxygen partial pressure of $1\times10^3$ Pa to $1\times10^5$ Pa and a water vapor partial pressure of 45 Pa or less with the ratio between the oxygen partial pressure and the water vapor partial pressure (oxygen partial pressure/water vapor partial pressure) being 600 to 20000, a step of subjecting the rare earth metal-based sintered magnet to a heat treatment at the heat treatment temperature at the same oxygen partial pressure and water vapor partial pressure as in the step of heating from ordinary temperature, and then a step of cooling the rare earth metal-based sintered magnet at the same oxygen partial pressure and water vapor partial pressure as in the step of heating from ordinary temperature and in the step of subjecting to the heat treatment.

2. The production method according to claim 1, characterized in that the atmosphere has a total pressure of $9\times10^4$ Pa to $1.2\times10^5$ Pa.

3. The production method according to claim 1, wherein:

the resulting surface-modified rare earth metal-based sintered magnet has a modification layer formed on the surface of the magnet;

the modification layer on the main phase of the surface of the magnet is constituted by an iron oxide made of 75 mass % or more hematite; and the modification layer on the grain boundary triple point is constituted by an R oxide made of 75 mass % or more $R_2O_3$.

* * * * *